US007267624B2

(12) United States Patent
Tapper et al.

(10) Patent No.: US 7,267,624 B2
(45) Date of Patent: Sep. 11, 2007

(54) GOLF BALL DIMPLE PATTERN

(75) Inventors: Charles J. Tapper, Fairhaven, MA (US); Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/909,090

(22) Filed: Jul. 30, 2004

(65) Prior Publication Data

US 2006/0025243 A1 Feb. 2, 2006

(51) Int. Cl.
*A63B 37/12* (2006.01)

(52) U.S. Cl. ..... 473/383

(58) Field of Classification Search ..... 473/379–385
See application file for complete search history.

(56) References Cited

U.S. PATENT DOCUMENTS 5,145,180 A * 9/1992 Oka ..... 473/382
5,156,404 A * 10/1992 Oka et al. ..... 473/382
6,358,161 B1 * 3/2002 Aoyama ..... 473/383
6,390,938 B1 * 5/2002 Asakura et al. ..... 473/378
6,610,812 B1 8/2003 Wu et al. ..... 528/60
6,685,580 B2 2/2004 Sullivan ..... 473/374
6,692,379 B2 2/2004 Morgan et al. ..... 473/371
2002/0165043 A1 * 11/2002 Winfield ..... 473/378
2003/0045378 A1 * 3/2003 Bissonnette et al. ..... 473/378
2003/0134695 A1 * 7/2003 Kasashima ..... 473/378
2003/0157999 A1 8/2003 Yu ..... 473/371
2004/0082407 A1 4/2004 Sullivan et al. ..... 473/371
2004/0082408 A1 4/2004 Sullivan et al. ..... 473/371
2004/0092335 A1 5/2004 Boehm et al. ..... 473/354

* cited by examiner

*Primary Examiner*—Raeann Trimiew
(74) *Attorney, Agent, or Firm*—Mandi B. Milbank

(57) ABSTRACT

A golf ball is provided with a dimple pattern comprising two substantially identical elongated dimple pattern elements which fit together to form the complete dimple pattern. The dimple pattern can contain 344 dimples covering about 70.4% of the golf ball surface or 392 dimples covering about 73.3%, or other combinations of dimple count and coverage. The sizes of the dimples can be varied among either four distinct dimple sizes ranging from about 0.14 inches to about 0.17 inches or eight distinct dimple sizes ranging from about 0.11 inches to about 0.175 inches, or other dimple size combinations. The arrangement of dimples on the golf ball can be divided into a plurality of triangles having identical dimple arrangements with bilateral symmetry.

6 Claims, 5 Drawing Sheets

GOLF BALL DIMPLE PATTERN

FIELD OF THE INVENTION

The present invention generally relates to golf balls, and more particularly to golf balls having improved arrangements of dimples on the surface.

BACKGROUND OF THE INVENTION

The aerodynamic configuration of a golf ball is an important factor in determining the performance characteristics, for example flight distance and trajectory shape, of the golf ball. Many different dimple pattern parameters influence aerodynamics. These parameters include dimple count, dimple coverage, i.e., the percentage of the surface of a golf ball that is covered or occupied by dimples, and the spatial relationships among the dimples.

Typically, dimple patterns have been composed of one or more repeating pattern elements, each of which is filled with a predetermined sub-arrangement of dimples. These elements usually total eight or more in number are typically polygonal in shape, having between three and six sides and generally correspond to the faces of a regular or semi-regular polyhedron.

Traditional polyhedron-based dimple arrangements provide a variety of options, but they also tend to favor particular dimple counts, particular coverage ranges and particular spatial relationships. For example, icosahedron-based dimple patterns tend to favor dimple counts such as 332, 392 and 432. In addition, these icosahedron-based dimple patterns tend to favor high dimple coverage and hexagonal packing, i.e., most dimples having six nearest neighbors. Octahedron-based layouts tend to favor 336 dimples, low dimple coverage and square packing.

U.S. Patent Application Publ. No. 2003/0157999 is directed to a golf ball having a cover including first and second hemispherical cups. The first and second hemispherical cups have a plurality of dimples provided on the outer circumference along each of the continuous first and second joint edges of the first and second hemispherical cups. No specifics are disclosed about the dimple coverage, number of dimples, dimples sizes or dimple packing. It appears, however, that a conventional icosahedron-based dimple pattern is used that has been arbitrarily divided into the two elongated regions, producing different arrangements of dimples within the two cups.

Therefore, a need remains for golf balls that utilize repeating dimple patterns and provide for alternative combinations of dimple count, dimple coverage, and dimple spatial relationships.

SUMMARY OF THE INVENTION

The present invention is directed to an arrangement of dimples on the surface of a golf ball. The surface comprises two substantially identical elongated elements and a plurality of dimples disposed in each elongated element. The dimples are arranged in each elongated element in substantially identical dimple patterns. The edges of the elongated elements meet to form a continuous boundary line. In one embodiment, one or more of the dimples are centered on the boundary line. Alternatively, the boundary line is substantially free of dimples.

In one embodiment, the golf ball contains 344 dimples, which occupy about 70.4% of the ball's surface area. In another embodiment, the golf ball contains 392 dimples, creating a dimple coverage of about 73.3%. In addition to being arranged in two identical elongated elements, each of these particular embodiments can be divided into a plurality of identical triangular elements. The arrangement of the dimples within these triangular dimple elements is symmetric with respect to a single line of symmetry, and the orientation of the plurality of triangular dimple elements is varied to achieve the desired overall dimple pattern and the identical elongated elements. Suitable arrangements for the dimples include a predominantly square dimple packing pattern.

In one embodiment, the dimples include four distinct dimple sizes ranging from about 0.14 inches to about 0.17 inches. In another embodiment, the dimples include eight distinct dimple sizes ranging from about 0.11 inches to about 0.175 inches.

In another embodiment, the triangular dimple element has the largest dimple at one vertex. The remaining dimples form concentric dimple lines around the largest dimple, and these concentric dimple lines are made up of dimples of the same size.

In another embodiment, the triangular dimple element has the smallest dimple at one vertex. The smallest vertex dimple is surrounded by concentric dimple lines. Most of these concentric dimple lines are made up of dimples of the same size. One of such lines is made up of the largest dimples.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
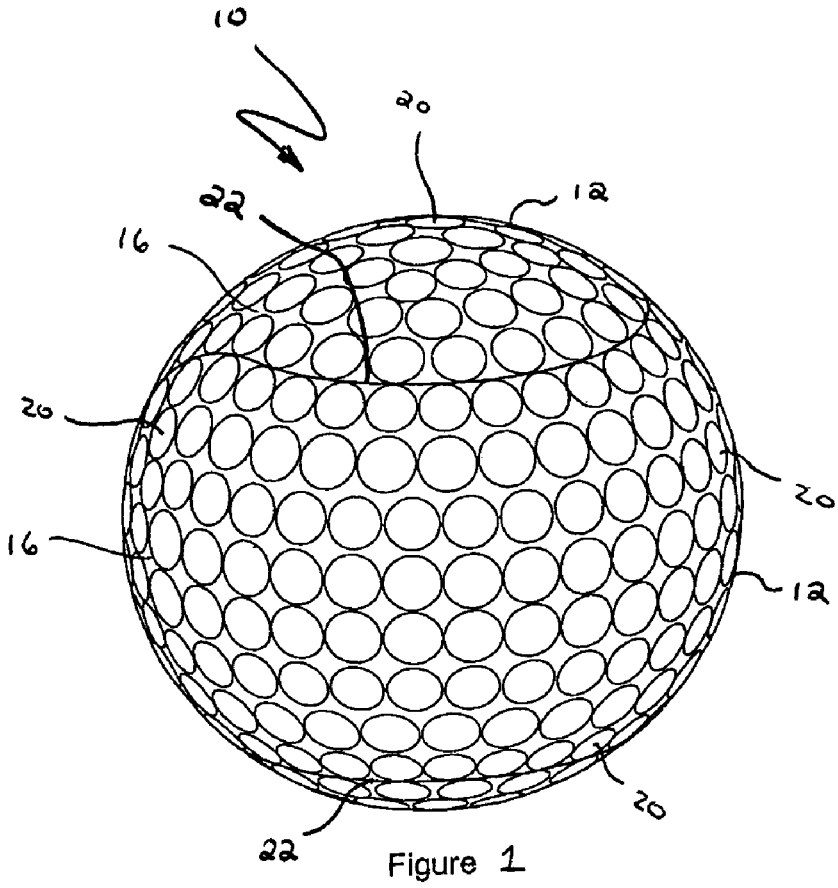
FIG. 1 is a perspective view of an embodiment of a golf ball in accordance with the present invention.
Figure 2:
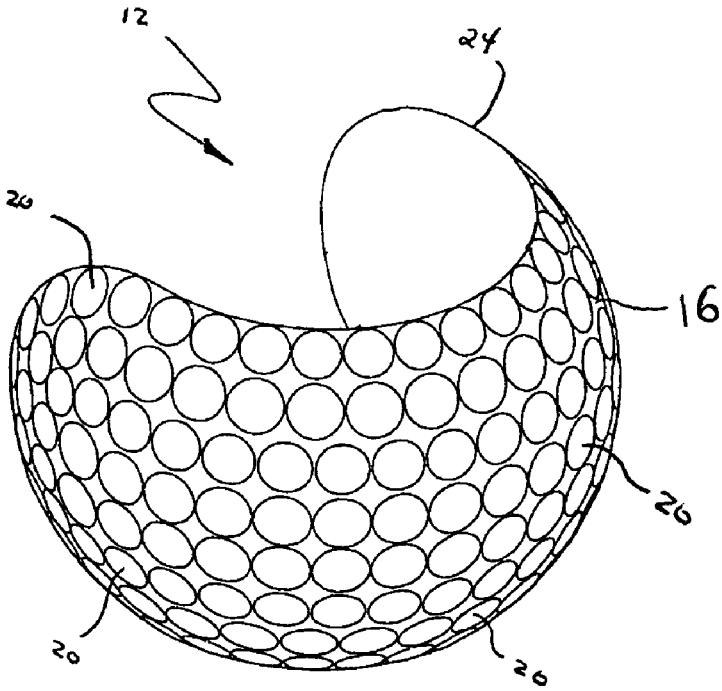
FIG. 2 is a perspective view of one of the elongated elements making up the dimple pattern of FIG. 1.

Referring initially to FIGS. 1 and 2, an embodiment of golf ball 10 in accordance with the present invention includes at least two substantially identical elongated dimple pattern elements 12 (one of which is isolated in FIG. 2). Elongated elements 12 are arranged to fit together to form the entire dimple pattern of golf ball 10. When fitted together, elongated elements 12 define continuous boundary line or path 22 at the junction or intersection of edges 24 of elongated elements 12. The arrangement and shape of boundary line 22 is defined by the shape of elongated elements 12. Any shape capable of dividing a spherical surface into at least two substantially identical, mating elongated elements 12 can be used in accordance with the present invention. Other suitable shapes include figure-eight, dumb bell, etc.

A plurality of dimples 20 is disposed on ball surface 16. Although dimples 20 can be formed to all have substantially the same size, preferably dimples 20 vary in size. For example, each dimple 20 can be any one of a plurality of different sizes. The number of dimple sizes can range from four to eight or more. Dimples 20 can be formed in any one of a number of shapes including spherical, rectangular and other geometric shapes. In the case of substantially spherical dimples having a substantially circular appearance, the size can be expressed as the diameter of the circle. In one embodiment, the dimple size ranges from about 0.14 inches to about 0.17 inches. In another embodiment, the dimple size ranges from about 0.11 inches to about 0.175 inches. Exemplary dimensions and packing of the dimples are given below.

The aerodynamic characteristics of golf ball 10 are also affected by the amount of surface 16 that is covered or occupied by dimples 20. In one embodiment, golf ball 10 contains 344 dimples having diameters ranging from about 0.14 inches to about 0.17 inches creating a dimple coverage of about 70.4%. In another embodiment, golf ball 10 contains 392 dimples having diameters ranging from about 0.11 inches to about 0.175 inches creating a dimple coverage of about 73.3%. In one embodiment, dimples 20 are arranged in a predominantly square dimple packing pattern. One or more dimples 20 can straddle boundary line 22, as long as these straddling dimples are centered along boundary line 22, so that each elongated element 12 includes one or more half dimples along its edge 24. Alternatively, boundary line 22 is substantially dimple-free.

Elongated elements 12 in accordance with the present invention preferably incorporate the same arrangement of dimples within each element and are, therefore, interchangeable. This uniformity produces consistent aerodynamic characteristics regardless of spin axis orientation, which in turn produces consistent flight and greater accuracy.

Since golf ball molding processes generally use two substantially hemispherical mold halves, each elongated element 12 would not be contained within a single mold half. Instead, only a portion of each elongated element 12 would be contained in any one mold half. Because of this discrepancy between the shape of elongated elements and the hemispherical mold halves and for ease in manufacturing the tooling for golf ball 10, in accordance to another aspect of the present invention, the overall dimple pattern can also be divided into a plurality of dimple pattern elements 26 shown in phantom in FIG. 3, and a single pattern element is shown in FIG. 4. Dimple pattern elements 26 are generally different from the shape of elongated elements 12 and are generally compatible with a hemispherical molding geometry.

In one embodiment, the pattern elements are arranged in an octahedron pattern of eight identical triangular elements having four elements disposed in each hemisphere the golf ball 10. This hemisphere can be the same hemisphere as defined by the two halves of the spherical mold used to make the golf balls for ease of manufacturing, although the present invention is not limited to hemispherical arrangements that correspond to the mold halves. The triangular elements correspond to the faces of a regular octahedron. Unlike typical polyhedron-based dimple patterns, triangular dimple pattern elements 26 in accordance with the present invention contain dimple arrangements that are isosceles as opposed to equilateral. Therefore, dimples pattern elements 26 have only bilateral symmetry, i.e., symmetry across a single line of symmetry, rather than full three-part rotational symmetry, and each dimple pattern element 26 is oriented to achieve the desired overall dimple pattern within the elongated elements. The creation of dimple pattern elements 26 is for purposes of manufacturing, however, and does not conflict with or eliminate the identical dimple patterns contained in identical elongated elements 12. Therefore, in addition to golf ball 10 being constructed of two substantially identical elongated members 12, each golf ball 10 is also constructed of a plurality of substantially identical triangles.

Figure 3:
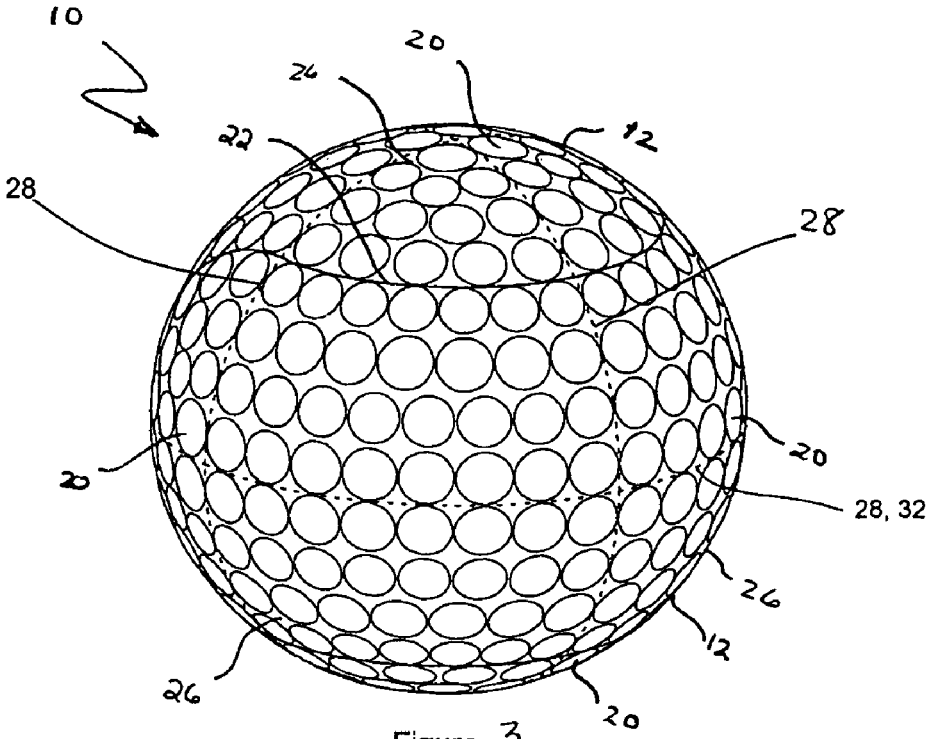
FIG. 3 is a perspective view of the same embodiment, showing an alternative set of dimple pattern elements.
Figure 4:
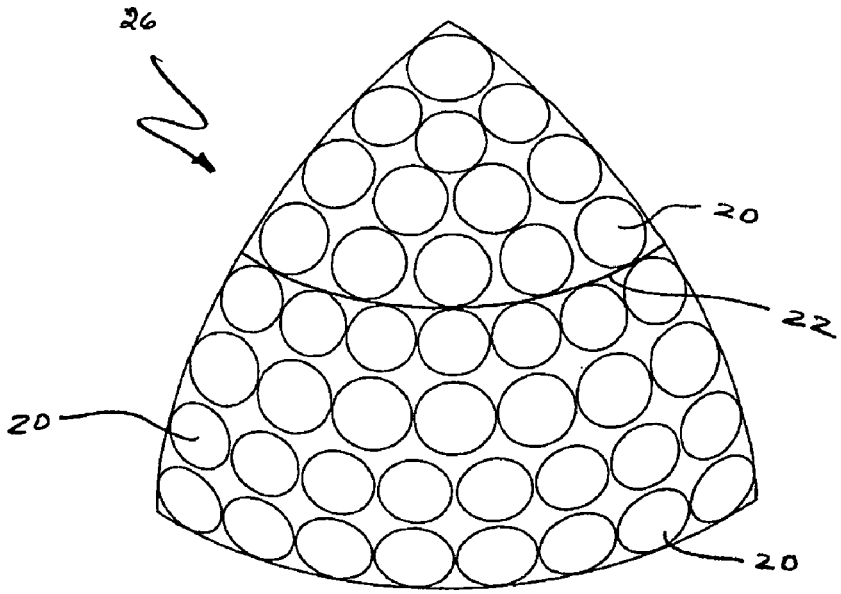
FIG. 4 is a front view of one of the alternative dimple pattern elements.

In one embodiment, golf ball 10 contains a total of 344 dimples 20 in two substantially identical arrangements disposed in the two identical elongated elements, as illustrated in FIG. 3. The 344-dimple embodiment covers about 70.4% of the surface of ball 10. Boundary line 22 indicates the intersection of these two identical elongated elements 12. Three great circles 28 drawn around golf ball 10 define eight alternative triangular dimple pattern elements 26, and each triangular element has an identical arrangement of dimples 20. For purposes of illustration, one great circle 28 is designated as equator 32 such that there are four triangles 26 on either side of equator 32, and the arrangement of triangles 26 on either side of equator 32 is identical. Comparable symmetries are achieved by designating other great circles 28 as equator 32.

Figure 5:
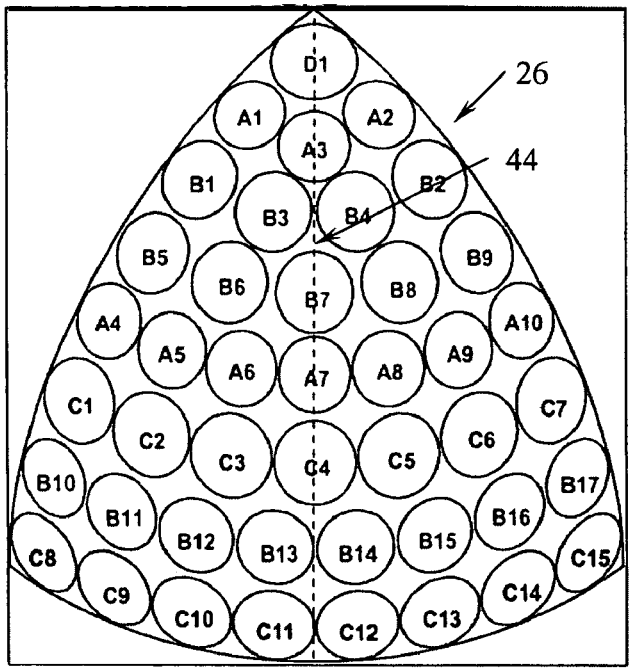
FIGS. 5, 6 and 7 are front view of the triangular pattern of FIG. 4 shown in three orientations.
Figure 6:
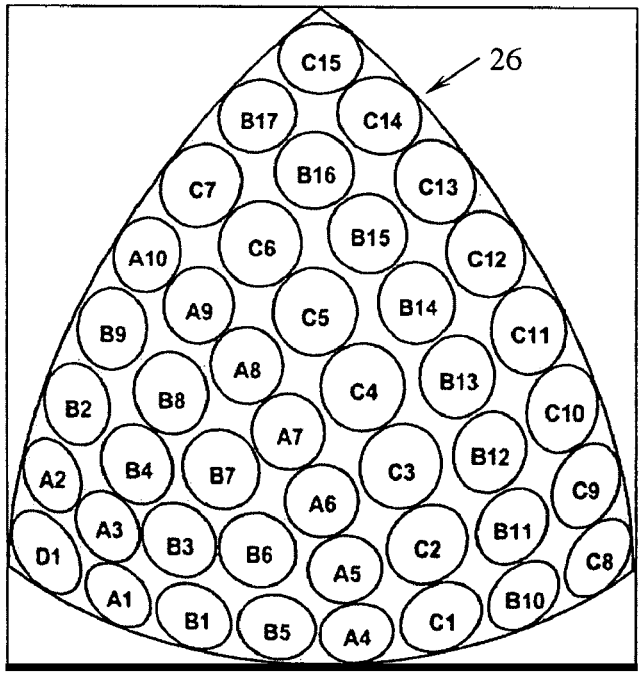
Figure 7:
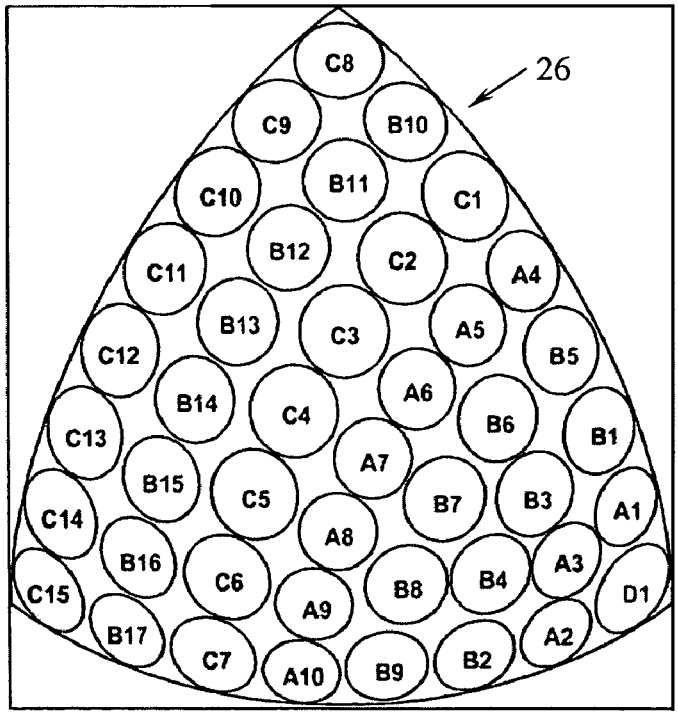

In the 344-dimple embodiment, four different sized dimples 20 are used, as summarized in Table 1 below and illustrated in FIGS. 5-7. Each of FIGS. 5-7 represents one or more triangular element 26 of the octahedron pattern shown in FIG. 4. In each element 26, the largest dimple, D1, is positioned at one vertex. In the first orientation shown in FIG. 5, D1 is located on the top vertex. In the second orientation shown in FIG. 6, triangle 26 has been rotated counter-clockwise relative to the first orientation by about 120° so that dimple D1 is located at the left vertex. In the third orientation shown in FIG. 7, triangle 26 has been rotated clockwise relative to the first orientation by about 120° so that dimple D1 is located at the right vertex.

In one embodiment, among the four triangles 26 on either side of equator 32, two of the triangle elements are arranged in the first orientation. One triangle element is arranged in the second orientation and the remaining triangle element is arranged in the third orientation. So arranged, the dimples of this embodiment provide good dimple coverage on the surface of the ball.

Referring to FIG. 5, a single line of symmetry 44 bisects dimples D1, A3, B7, A7 and C4. This line also extends between pairs B3/B4, B13/14 and C11/C12. As discussed above, triangular dimple patterns 26 have bilateral symmetry. Additionally in this embodiment, each triangular pattern 26 can be viewed relative to the largest dimple, D1, as having substantially concentric lines of dimples emanating from dimple D1. In other words, D1 is surrounded by a first concentric line containing dimples A1, A2, and A3, which in turn is surrounded by a second concentric line containing dimples B1, B2, B3 and B4, which is in turn surrounded by a third concentric line containing dimples B5, B6, B7, B8 and B9, and so on. Therefore, the concentric lines of dimples are concentric to the vertex adjacent the largest dimple D1. Uniquely, each concentric line is populated by dimples of the same size.

Table 1 shows the dimple diameters associated with each dimple position of triangle 26 shown in FIGS. 5, 6, and 7.

TABLE 1

| 344 DIMPLES | |
|---|---|
| Dimple | Diameter |
| A1 | 0.140 |
| A2 | " |
| A3 | " |
| A4 | " |
| A5 | " |
| A6 | " |
| A7 | " |
| A8 | " |
| A9 | " |
| A10 | " |
| B1 | 0.150 |
| B2 | " |
| B3 | " |
| B4 | " |
| B5 | " |
| B6 | " |
| B7 | " |
| B8 | " |
| B9 | " |
| B10 | " |
| B11 | " |
| B12 | " |
| B13 | " |
| B14 | " |
| B15 | " |
| B16 | " |
| B17 | " |
| C1 | 0.160 |
| C2 | " |
| C3 | " |
| C4 | " |
| C5 | " |
| C6 | " |
| C7 | " |
| C8 | " |
| C9 | " |
| C10 | " |
| C11 | " |
| C12 | " |
| C13 | " |
| C14 | " |
| C15 | " |
| D1 | 0.170 |

Figure 8:
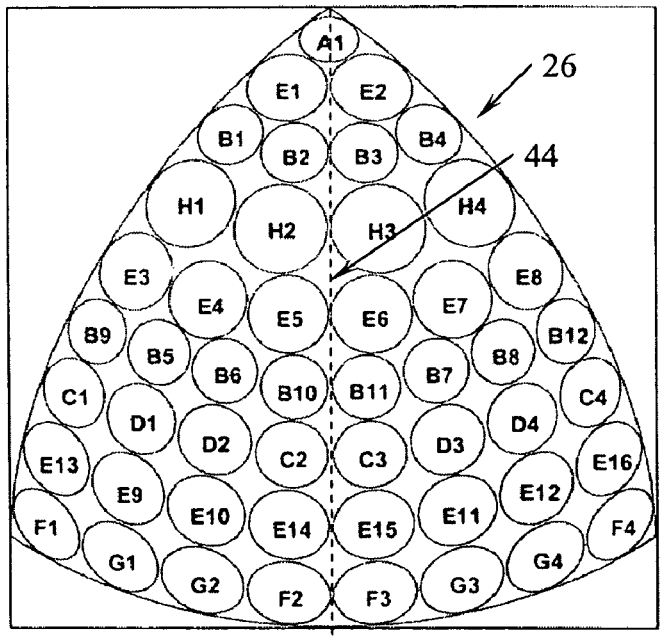
FIG. 8 is a front view of another triangular pattern.
Figure 9:
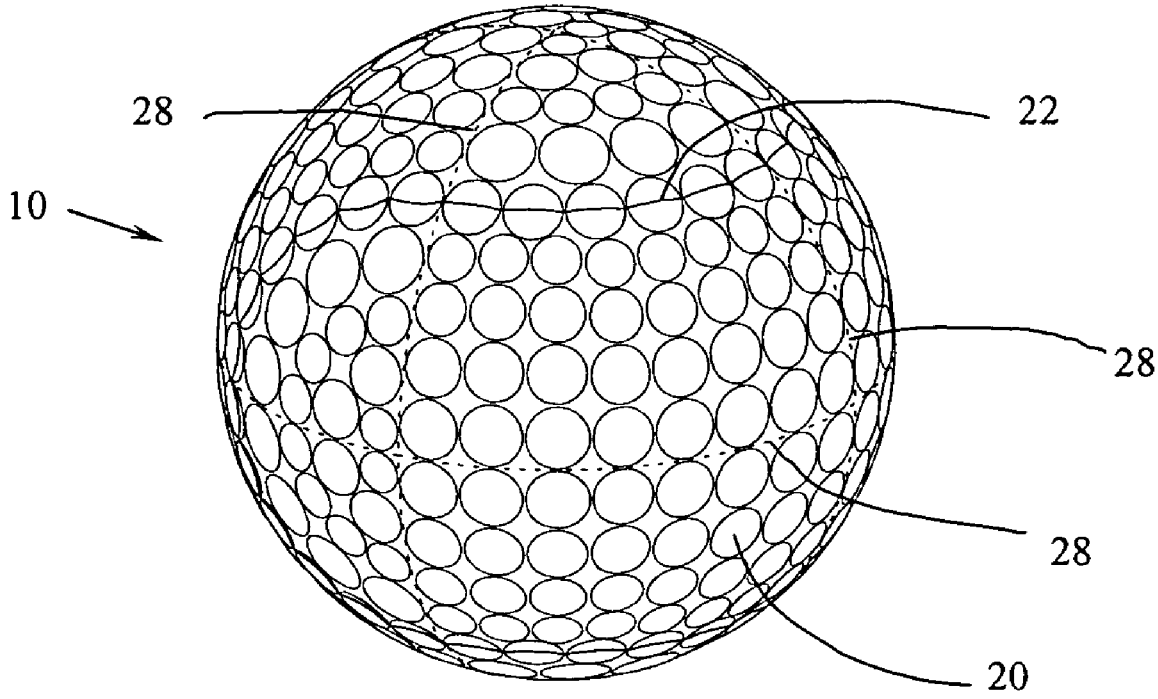
FIG. 9 is a perspective view of another embodiment of a golf ball in accordance with the present invention comprising the triangular pattern of FIG. 8.

In another embodiment as illustrated in FIGS. 8 and 9, golf ball 10 contains 392 total dimples having eight different sizes, as shown in Table 2. The 392-dimple embodiment covers about 73.3% of the surface of golf ball 11. Similar to the 344-dimple embodiment, the 392-dimple embodiment comprises eight triangular dimple patterns 26. As shown in FIG. 8, each triangular pattern contains substantially bilateral symmetry about line of symmetry 44. In this embodiment, line 44 bisects vertex dimple A1 and extends between pairs E1/E2, B2/B3, H2/H3, E5/E6, B10/B11, C2/C3, E14/E15 and F2/F3. In this embodiment having a pattern of 392 dimples, vertex dimple A1 is the smallest dimple. Vertex dimple A1 is also surrounded by lines of dimples that are essentially concentric to the vertex adjacent the smallest dimple A1. A plurality of these concentric lines contains dimples of the same size. More specifically, concentric dimple lines containing pairs E1/E2, B2/B3, H2/H3, E5/E6, B10/B11 and E14/E15 have dimples of the same size, while concentric dimple lines C2/C3 and F2/F3 do not. Additionally, one of the concentric lines, H1, H2, H3 and H4, contains the biggest dimples.

| Dimple | Diameter |
|---|---|
| A1 | 0.110 |
| B1 | 0.125 |
| B2 | " |
| B3 | " |
| B4 | " |
| B5 | " |
| B6 | " |
| B7 | " |
| B8 | " |
| B9 | " |
| B10 | " |
| B11 | " |
| B12 | " |
| C1 | 0.135 |
| C2 | " |
| C3 | " |
| C4 | " |
| D1 | 0.140 |
| D2 | " |
| D3 | " |
| D4 | " |
| E1 | 0.150 |
| E2 | " |
| E3 | " |
| E4 | " |
| E5 | " |
| E6 | " |
| E7 | " |
| E8 | " |
| E9 | " |
| E10 | " |
| E11 | " |
| E12 | " |
| E13 | " |
| E14 | " |
| E15 | " |
| E16 | " |
| F1 | 0.155 |
| F2 | " |
| F3 | " |
| F4 | " |
| G1 | 0160 |
| G2 | " |
| G3 | " |
| G4 | " |
| H1 | 0.175 |
| H2 | " |
| H3 | " |
| H4 | " |
| | " |

In one embodiment, the triangular dimple patterns 26 of the 392-dimple embodiment are arranged on ball 10 in the same way as the triangular dimple patterns of the 344-dimple embodiment, discussed above. The dimple diameters are shown in the table above.

As illustrated in FIG. 9, various orientations of the four triangles 26 in each hemisphere are selected to produce the desired identical elongated elements. As illustrated, each hemisphere contains two adjacent triangles 26 in a first orientation, one triangle 26 in a second orientation and one triangle 26 in a third orientation. The other hemisphere is identical, and the definition of symmetry and orientation of line of symmetry 44 is the same as for the other embodiment.

Golf ball 10 can be of any construction type and can include one or more inner cover layers or core layers. Suitable core layers are typically made from a cross-linked rubber based polymer, and are known and available in the art. Suitable cores and core layers are disclosed in commonly owned U.S. patents and US published patent applications, such as U.S. Pat. Nos. 6,692,379, 6,685,580 and 6,610,812 and U.S. Patent Application Pub. Nos. 2004/

0092335, 2004/0082408 and 2004/0082407, which are incorporated herein by reference in their entireties.

Other than in the operating examples, or unless otherwise expressly specified, all of the numerical ranges, amounts, values and percentages such as those for amounts of materials, dimensions and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While all of the dimples disclosed herein have been circular in shape, it will be understood and appreciated by one of ordinary skill in the art that other dimple shapes could also be employed to good effect within the scope of the invention. For example, dimples with a pentagonal, hexagonal, or other polygonal shape could be used, as could elongated, annular, multi-lobed, teardrop, elliptical, or other shaped dimples. For the disclosed circular dimples, the size is characterized by the diameter of the dimple. For other shapes, the size is characterized by an equivalent diameter that is calculated as the diameter of a circle occupying the same area on the ball's surface. For example, a square dimple with sides measuring 0.150 inches occupies an area of 0.0225 square inches. A circle occupying 0.0225 square inches would have a diameter of about 0.169 inches, which is defined as the equivalent diameter of the square dimple. As is common practice, for simplicity these calculations were performed using plane geometry formulas without taking into account the spherical curvature of the ball's surface. For dimples of typical size, it is understood that the amount of error introduced by this simplification is quite small. It is also appreciated that in some cases (especially for large dimples) it may be necessary to perform the exact calculation using formulas from solid geometry.

While it is apparent that the illustrative embodiments of the invention disclosed herein fully describe the present invention, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball dimple pattern comprising:

two substantially identical elongated elements capable of fitting together to form the complete dimple pattern; and a plurality of dimples disposed in each one of the elongated elements, wherein the plurality of dimples forms an identical dimple pattern in each elongated element;

wherein the plurality of dimples are capable of being divided into a plurality of triangles, each triangle comprising an identical arrangement of dimples, and wherein the plurality of dimples comprises 344 total dimples comprising four different dimple diameters ranging from about 0.14 inches to about 0.17 inches.

2. The golf ball dimple pattern of claim 1, wherein each triangle comprises a single dimple of a largest size, the largest sized dimple disposed adjacent one of the vertices of the triangle.

3. The golf ball dimple pattern of claim 1, wherein the arrangement of dimples within each triangle is symmetric with respect to a line bisecting one angle of the triangle.

4. The golf ball dimple pattern of claim 1, wherein three dimples are disposed adjacent three vertices of each triangle and one of these three dimples comprises a size that is different than the other two dimples.

5. The golf ball dimple pattern of claim 1, wherein the plurality of dimples can be divided into eight triangles.

6. The golf ball dimple pattern of claim 5, wherein four of the eight triangles are disposed in each of two hemispheres of the golf ball.

* * * * *